US006253938B1

(12) United States Patent
Zaksenberg et al.

(10) Patent No.: US 6,253,938 B1
(45) Date of Patent: Jul. 3, 2001

(54) INDIRECTLY ACTIVATED CLOSURE

(75) Inventors: Issac Zaksenberg, Scotch Plains; Alan Nimmey, Warren; Kevin Harrity, Middlesex, all of NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/160,996

(22) Filed: Sep. 25, 1998

(51) Int. Cl.[7] ..... B65D 41/02; B65D 51/18

(52) U.S. Cl. ..... 215/237; 215/295; 215/301; 220/254; 220/259; 220/283; 220/836

(58) Field of Search ..... 215/237, 235, 215/295, 301; 220/254, 259, 260, 262, 263, 264, 281, 282, 283, 810, 836; 222/153.01, 556, 557, 562

(56) References Cited

U.S. PATENT DOCUMENTS

| | | | | |
|---|---|---|---|---|
| 2,111,186 | | 3/1938 | Jenks . | |
| 2,342,477 | | 2/1944 | Magnenat . | |
| 3,252,492 | | 5/1966 | Marchant . | |
| 3,516,581 | | 6/1970 | Micallef . | |
| 4,487,324 | | 12/1984 | Ostrowsky . | |
| 4,607,768 | * | 8/1986 | Taber et al. | 215/237 |
| 4,666,068 | | 5/1987 | Bush . | |
| 4,776,501 | | 10/1988 | Ostrowsky . | |
| 4,863,048 | | 9/1989 | Iizuka et al. . | |
| 4,949,883 | | 8/1990 | Dubach . | |
| 5,213,235 | | 5/1993 | Miranda . | |
| 5,551,607 | | 9/1996 | DeJonge, Sr. et al. . | |
| 5,573,127 | * | 11/1996 | Takahashi et al. | 220/264 |
| 5,582,316 | * | 12/1996 | Masayoshi et al. | 220/264 |
| 5,730,310 | * | 3/1998 | Yoshihara | 220/283 X |
| 5,735,438 | | 4/1998 | Ostrowsky . | |
| 5,746,338 | * | 5/1998 | Takahashi et al. | 220/254 |
| 5,873,476 | * | 2/1999 | Takahashi et al. | 220/254 |

FOREIGN PATENT DOCUMENTS

| | | |
|---|---|---|
| 295 07 685 U | 7/1995 | (DE) . |
| 0 325 894 | 8/1989 | (EP) . |
| 0 547 978 | 6/1993 | (EP) . |
| 0 609 467 | 8/1994 | (EP) . |
| 0 819 615 | 1/1998 | (EP) . |

* cited by examiner

*Primary Examiner*—Allan N. Shoap
*Assistant Examiner*—Niki M. Eloshway
(74) *Attorney, Agent, or Firm*—Michael J. McGreal

(57) ABSTRACT

The present closure is one that is actuated and opened indirectly. A force on a push pad causes the lid to open. There is no direct manual force applied to the lid to open the lid. The closure is comprised of a base section and a lid section. These are separate molded sections. These separate molded sections are attached after molding. The base section has the attachment to a container, structural integrity, a spout, and a lid actuator mechanism. The lid actuator mechanism is comprised of a strap with a push pad with an actuator rod at the end adjacent an actuator wall. The lid section has a spout closing section for the spout of the base section and an attachment fitting for attachment to the base section. The spout closing section is attached to the attachment fitting by living hinges, and preferably, preloaded living hinges. Such living hinges reduce the force to actuate. The closure is opened by pushing on a push pad which in turn causes the living hinges to be actuated and the lid snap opened. The lid is manually closed.

12 Claims, 5 Drawing Sheets

INDIRECTLY ACTIVATED CLOSURE

FIELD OF THE INVENTION

This invention relates to a closure for a container where the closure is opened by applying an indirect force to the lid of the closure. More particularly, this invention relates to a two piece closure that has molded hinges that are preloaded to open a lid upon the application of an indirect force.

BACKGROUND OF THE INVENTION

This invention relates to a closure for a container such as a bottle or a tube where the lid closing the dispensing opening of the closure is opened by applying a force to one surface which translates this force to a second surface which opens the lid. This is in distinction to most closures where the direct force is applied to a lid to open the lid.

Typical closures for containers are shown in U.S. Pat. No. 3,516,581; U.S. Pat. No. 4,776,501; and U.S. Pat. No. 4,487,324. Each of these closures is opened by the direct application of a force to the lid of the closure. In U.S. Pat. No. 3,516,581 and U.S. Pat. No. 4,776,501, there are disclosed disc closures. The disc pivots at about a midpoint. By applying a downward force opposite the end covering the dispensing opening, the lid is opened and the dispensing opening uncovered. These are sometimes described as toggle closures. In U.S. Pat. No. 4,487,324 there is disclosed a closure lid that is opened pushing the lid upward to rotate the lid on a set of hinges that connect the lid of the closure to the base of the closure. The lid opens upward to an angle of 90° or better.

These are two of the common closures used on tube packaging and on bottles. These also are examples of common closures where to open the closure there is a direct force applied to the closure. This direct force on a part of the lid of the closure will open the closure.

The new closure of this invention is an indirectly opening closure. A force is applied to one surface of the closure which transfers this force to another part of the closure which opens the lid. The lid is manually closed. The closure is formed in two pieces. The base portion of the lid has portion for attachment to a container and an elongated actuator section comprising an elongated rod that has one or more hinges and terminates in a section that is in a close relationship with an actuator wall. The actuator wall is attached to the dispensing opening lid by a hinge, preferably a preloaded living hinge. When a force is applied to the actuator section, the force is translated to actuator wall and thereby to open the lid.

The base portion with the actuator section preferably is molded in one piece. The lid also preferably is separately molded with the hinge of the lid being preloaded during molding. By preloaded is meant that the hinge is set so that a small force and movement of the actuator wall of the lid will cause the lid to spring open.

This type of closure has the advantage that is easy to open, requiring less force than the direct opening closures. It is very useful for persons who through age or otherwise do not have a high level of strength in their hands.

BRIEF SUMMARY OF THE INVENTION

The present invention is directed to an indirectly activated closure for a container, such as a tube or a bottle. The closure is opened by applying a force to one surface of the closure, which force is transferred to a part of a lid assembly which then opens the lid. This invention also is directed to the assembly and use of this closure.

The closure has a base portion and a lid portion. The lid portion is attached to the base portion by an interfitting closure attaching section. The base portion has a section for attachment to a container, a dispensing opening and a list activation section. The lid section has an activator wall, a lid hinge, and preferably a pre-loaded living hinge, and portion closing the dispensing opening. In use a force is applied to the lid activation section which causes and activator rod to contact the activator wall to in turn cause the lid hinge to open and open the dispenser opening.

The closure is produced in two sections. The base section and the lid section. The lid section is attached to the base section and the activator section is folded into place with the actuator rod adjacent the actuator wall of the lid section. The closure then can be attached to a container.

The closure is activated by applying a force to the activator section which in turn applies the force to the activator wall of the lid section. Upon applying this force to the activator wall the lid opens. The lid is manually closed after dispensing.

DETAILED DESCRIPTION OF THE INVENTION

The present indirectly opening closure is comprised of two sections. There is the base section and the lid section. The lid section and the base section are separately molded with the lid section intermitted onto the base section. These sections are conveniently injection molded from any of the commonly used injection molding resins. These include the polyolefins such as the polyethylene and the polypropylenes.

Figure 1:
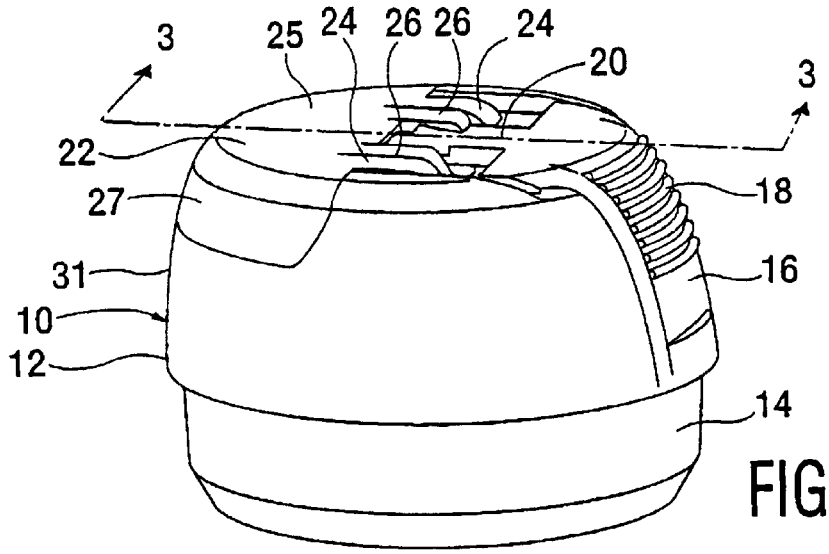
FIG. 1 is a perspective view of the closure of the indirectly opening closure of the present invention.

FIG. 1 describes the closure in more detail. The closure 10 is comprised of base section 12 and lid section 22. A lower part of the base section is the container connecting portion 14. This is shown as an interfitting arrangement. However, this can be threaded or latched to a container. In such embodiments the container would have a cooperating thread or latching arrangement.

Figure 2:
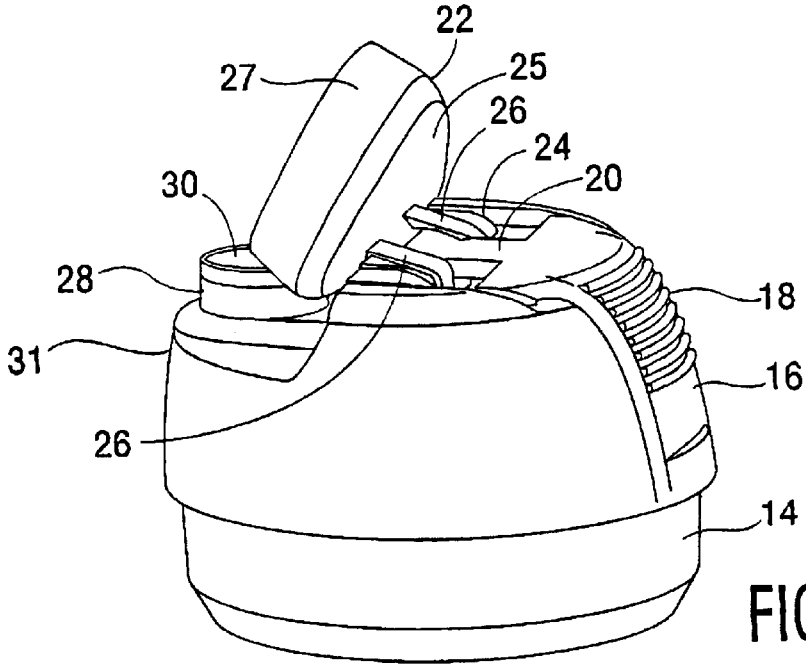
FIG. 2 is a perspective view of the closure of FIG. 1 in an opened condition.
Figure 3:
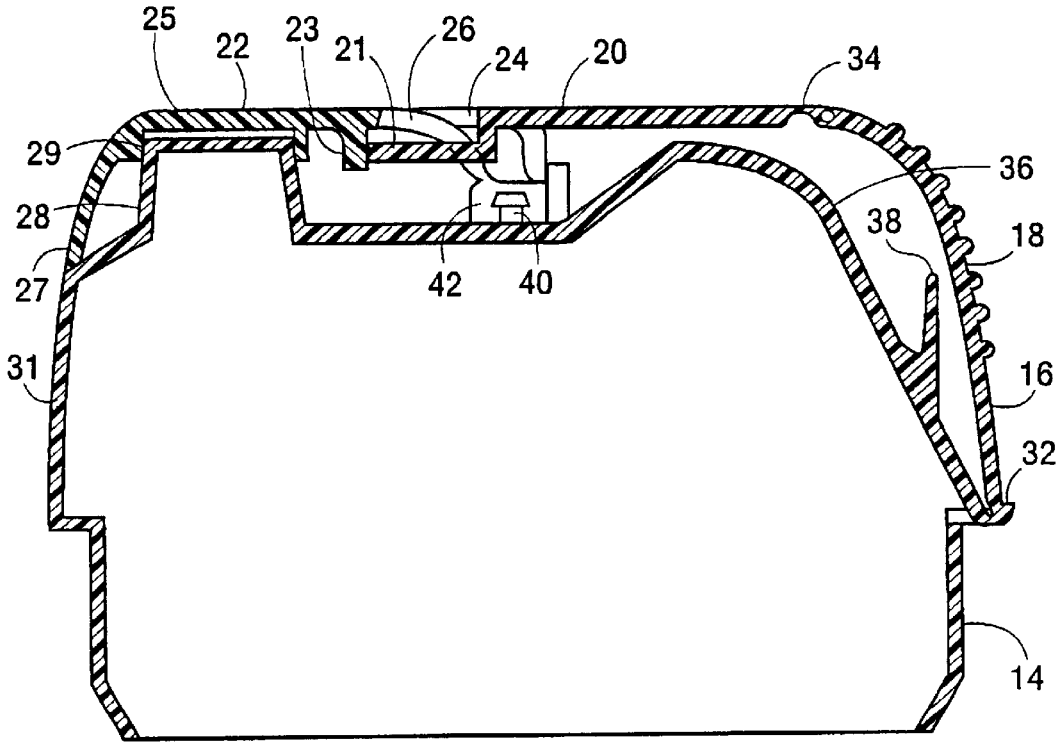
FIG. 3 is vertical cross-section of the closure of FIG. 1 along 3—3.

As is seen in FIGS. 1 through 3 the base section in addition to the connecting portion 14 is comprised of strap 16 which has push pad 18 and actuator rod 20. The actuator rod has a lid contact section 21. The actuator rod has hinge points at 32 and 34. Located under the strap 16 is base support member 36. This base support member provides rigidity to the closure and supports the pin 40 for attachment of the lid section. It also supports lever spring 38. This lever spring 38 causes the strap 16 to recede to its original position after opening the lid 22. Adjustment section 19 provides an offset for the actuator rod 21. The actuator rod can be at various levels so as to contact actuator wall 23 at an optimum point.

As shown in FIG. 2 the base carries spout 28 that has dispensing aperture 30. The lid section 22 closes spout 28.

The lid section has a top wall 25 and a sidewall 27. Circumferential section 29 encircles spout 28 to seal the spout in a closed condition. The lid section also has downwardly depending actuator wall 23 and a lid attachment fitting 42 which latches onto connecting pin 40 of the base portion. These comprise the lid attachment section. Hinges 24 and 26 attach the lid top wall 25 to the lid attachment fitting 42 This attachment is shown in FIGS. 3–6 and in detail in FIG. 6.

Figure 4:
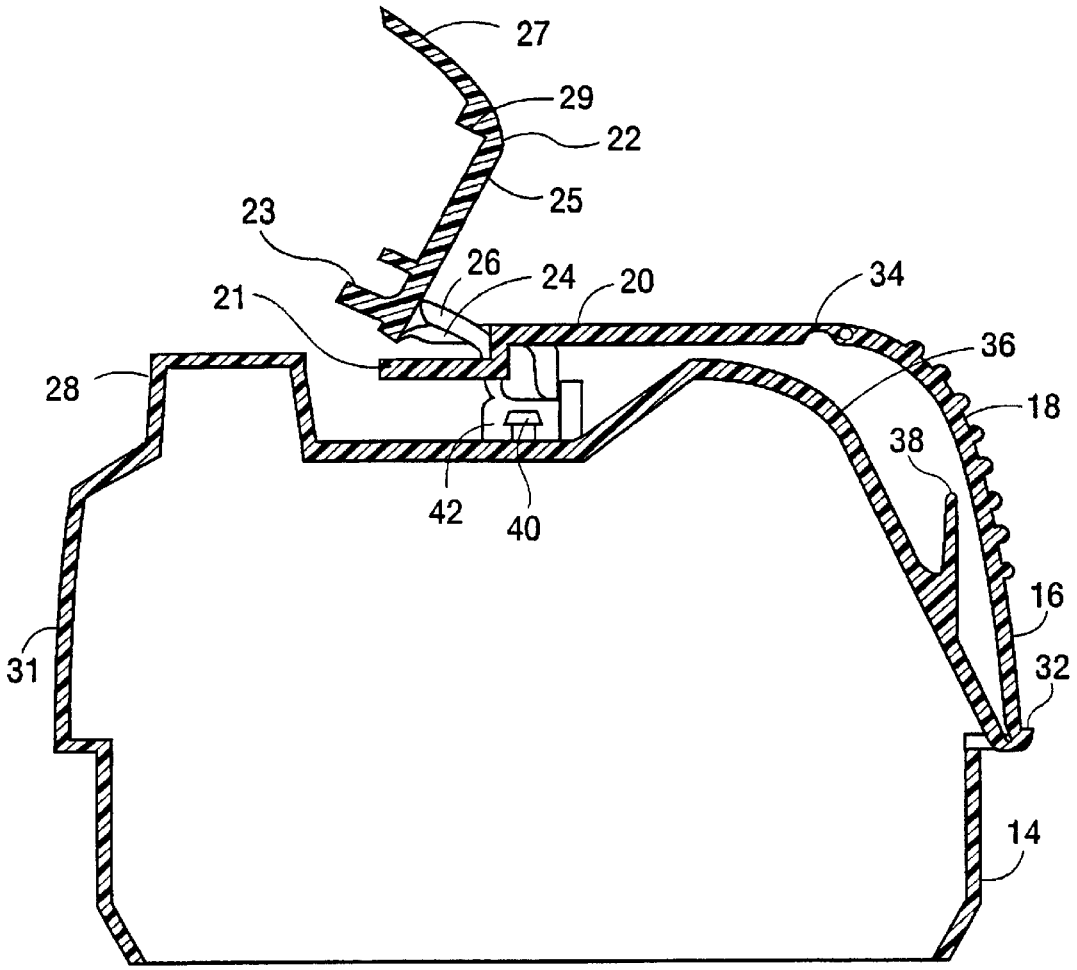
FIG. 4 is a vertical cross-section of the closure of FIG. 1 opened.

In FIG. 3 there is shown the closure in a vertical cross-section. Here the lid 22 is closed. However, all of the described principal parts of the closure are shown in detail. In order to open the closure as shown in FIGS. 2 and 4, actuator rod 21 is pushed against actuator wall 23. This causes the movement of the actuator wall 23 towards spout 28. This in turn causes the lid 27 to open on hinges 24 and 26. This is shown in detail in FIG. 4. The force to cause lid contact section of actuator rod 21 to contact the actuator wall 23 is a force on push pad 18 moving the push pad towards spring 38. A slight force on the push pad is sufficient to move the actuator rod the short distance to open the lid 22.

Figure 5:
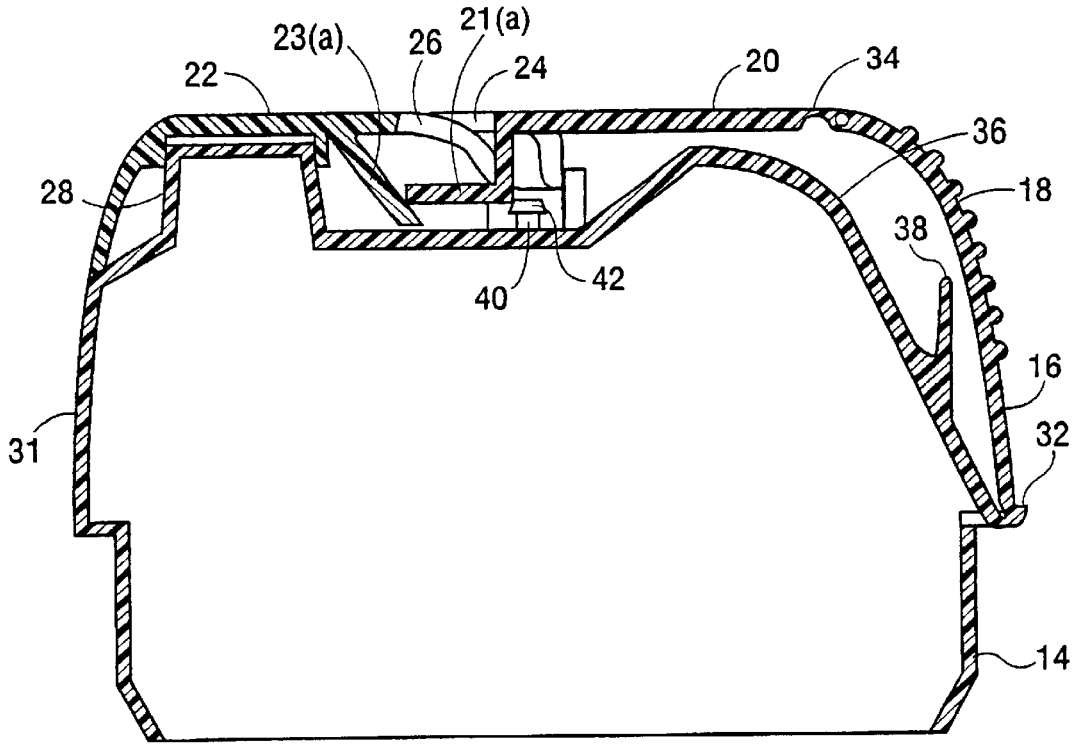
FIG. 5 is a vertical cross-section of an alternate embodiment of the structure of FIG. 3.

FIG. 5 shows an alternate construction for the actuator wall 23(*a*). Also, in this embodiment actuator rod 21(*a*) is extended downward to contact the actuator rod at a lower point. Otherwise the structure of the closure of FIG. 5 is substantially similar to that of FIG. 3.

Figure 6:
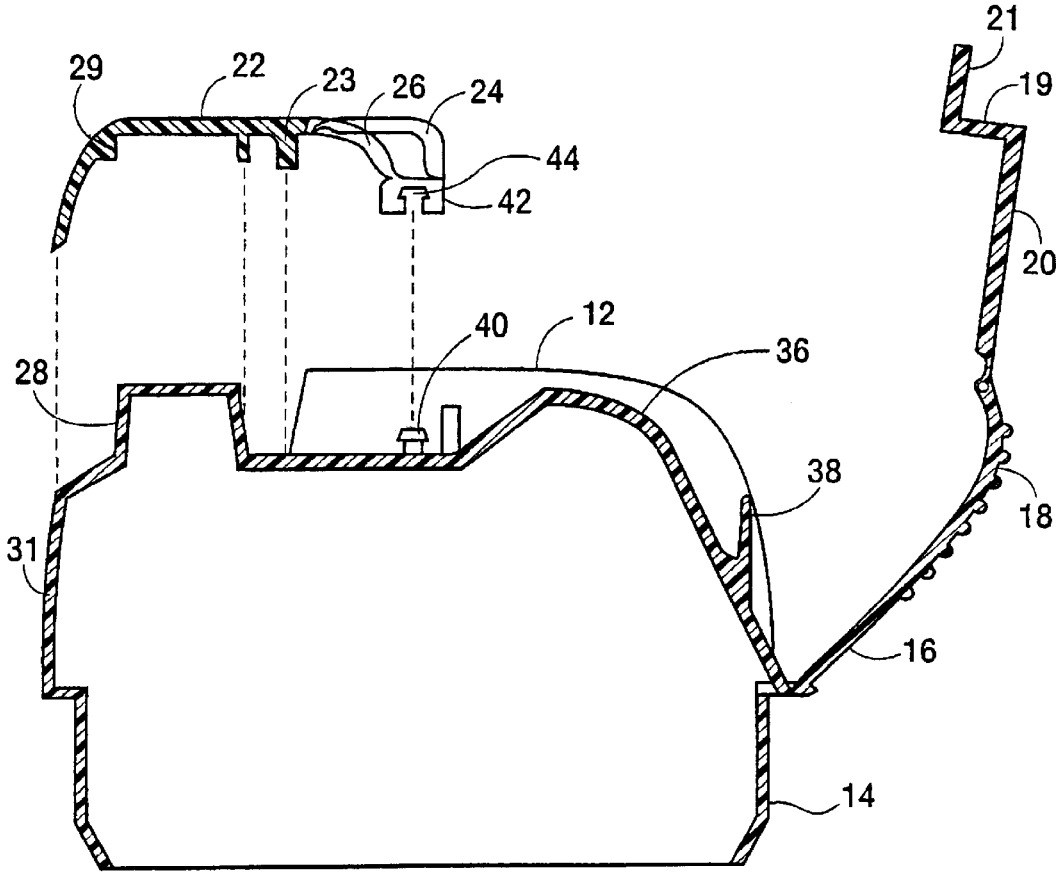
FIG. 6 is an exploded view of the two sections that comprise the closure.

FIG. 6 discloses the closure of FIG. 3 in an exploded view. The closure also is injection molded in the two sections shown in this view. After molding the attachment fitting attaches to the pin 40. The pin 40 has an enlarged head portion which is accepted into an attachment fitting 42 with an enlarged internal section. These mating sections snap into place to hold the lid section onto the base section. Assembly is easy and quick.

The hinges on the lid section preferably are in the form of a preloaded living hinge. A living hinge is one which after a partial movement to open or close the hinge, the hinge will snap to an open or to a substantially closed position. Such hinges are commonly used on many personal care packages including shampoos, lotions and dentifrices. A preloaded living hinge is one where the stretched hinges are preloaded. That is, the hinges are formed with the lid partially closed. This is shown in FIG. 7. In this view pivot hinges 26 and stressed hinges 24 are molded in this manner so that a small movement of actuator wall 23 will cause the lid to open. Depending on the angle of the stressed hinges from 0° to the horizontal to the ±30° to the horizontal the degree of force, and the travel required for the actuator wall to open the lid can be adjusted. In the present instance it is desired to minimize the travel distance of actuator wall 23 and hence, the force to actuate. It is desired to minimize the force to actuate.

This description and the drawings set out a preferred embodiment of the closure. Various modifications can be made and yet maintain the feature of an indirect opening of the closure and a low force to actuate. As noted, a low force to actuate is needed for people with low hand strength. All such modifications which embody the inventive concepts disclosed herein are within the scope of the present invention.

What is claimed is:

1. An indirectly activated closure comprising a separate base section and a separate lid section, means at one end of said base section for attaching said base section to a container and at an other end of said base section for attaching said lid section to said base section, said lid section closing a dispensing aperture in said base section, an actuator integrally connected to said base section, said actuator comprised of a strap which extends upwardly of said base section and across at least a portion of a top part of said base section to adjacent said separate lid section to form a part of a top surface of said closure, a first part of said actuator adjacent said lid section and a second part of said actuator adjacent to the connection to said base section, said second part of said actuator contacted by the finger of a user to move said actuator inwardly whereby when said actuator is moved inwardly said first part of said actuator contacts said lid section and causes a closing device of said lid section closing said dispensing aperture to retract and to open said dispensing aperture.

2. An indirectly activated closure as in claim 1 wherein said lid section has an interfitting lid attaching section that interfits with a base section attaching section, and an actuator wall between said lid attaching section and said closing device, said actuator strap having an actuator rod adjacent said actuator wall, said actuator strap having at least one hinge and pivoting at said at least one hinge, whereby when said actuator strap is moved inwardly said actuator rod is moved toward said actuator wall and said actuator rod causes said actuator wall to move upwardly and to cause said closing device to move out of contact with said aperture to open said aperture.

3. An indirectly activated closure as in claim 2 wherein the actuator strap has at least two hinges.

4. An indirectly activated closure as in claim 2 wherein said actuator strap has a portion intermediate said at least one hinge and the end of said actuator rod adjacent said actuator wall for moving said actuator rod inwardly toward said base portion to cause the end of said actuator rod to contact said actuator wall.

5. An indirectly activated closure as in claim 4 wherein there is a spring device on said base section adjacent said actuator strap, said spring device contacting said actuator strap when said actuator rod is activated to contact said actuator wall to return said actuator rod to a position where it is not in contact with said actuator wall and said actuator strap to an initial position.

6. An indirectly activated closure are in claim 4 wherein there is an actuator strap support pin on a top part of said base section, said actuator rod contacting and being supported on the support pin.

7. An indirectly activated closure as in claim 2 wherein said lid section has a living hinge intermediate said lid attachment section and said closing device.

8. An indirectly activated closure as in claim 7 wherein said living hinge is adjacent to said lid attachment section.

9. An indirectly activated closure as in claim 2 wherein said lid attaching section comprises a socket adapted to receive a pin extending upwardly from said base section.

10. An indirectly activated closure as in claim 1 wherein said dispensing aperture is parallel to the vertical axis of said base portion.

11. A method of assembling an indirectly activated closure comprising providing a closure having a separate lid section and a separate base section, assembling said lid section onto a top part of said base section and placing a closing device of said lid section in alignment with an aperture opening for dispensing a substance in said base section, folding an actuator strap hingedly connected to a lower part of said base section upwardly along said base section and over a portion of said top part of said base section to form part of the top wall of said closure, an actuator rod at an end of said strap distant from the attachment to said base section being adjacent an actuator wall of said lid section whereby upon the depression of said actuator strap inwardly said actuator rod contacts said actuator wall and said closing device is moved out of contact with said aperture.

12. A method of assembling an indirectly activated closure as in claim 11 wherein said actuator strap is folded at a second hinge.

* * * * *